United States Patent [19]

Iwasaki et al.

[11] Patent Number: 4,566,068

[45] Date of Patent: Jan. 21, 1986

[54] CHARACTERISTIC SIGNAL GENERATOR FOR AN ELECTRONICALLY CONTROLLED FUEL INJECTION PUMP

[75] Inventors: Yuji Iwasaki, Sakado; Kyoichi Fujimori, Higashimatsuyama; Yasuhiro Hiyama, Musashino, all of Japan

[73] Assignee: Diesel Kiki Co., Ltd., Tokyo, Japan

[21] Appl. No.: 443,597

[22] Filed: Nov. 22, 1982

[30] Foreign Application Priority Data

Nov. 26, 1981 [JP] Japan ..... 56-174732
Dec. 4, 1981 [JP] Japan ..... 56-180125

[51] Int. Cl.[4] ..... F02D 5/02; F02M 59/20

[52] U.S. Cl. ..... 364/431.05; 123/357; 123/486

[58] Field of Search ..... 364/431.01, 431.03, 364/442; 123/357, 440, 486

[56] References Cited

U.S. PATENT DOCUMENTS 3,835,819 9/1974 Anderson et al. ..... 364/442
3,838,397 9/1974 Watson et al. ..... 364/442
3,909,601 9/1975 Yamawaki et al. ..... 123/486
4,130,095 12/1978 Bowler et al. ..... 123/440
4,364,351 12/1982 Romblom et al. ..... 123/357
4,443,852 4/1984 Kobayashi et al. ..... 364/431.03
4,453,516 6/1984 Filsinger ..... 123/357

OTHER PUBLICATIONS

Sheingold: Analog Digital Conversion Handbook, pp. I-64, I-65, of interest.

*Primary Examiner*—Felix D. Gruber
*Attorney, Agent, or Firm*—Guy W. Shoup

[57] ABSTRACT

In a characteristic signal generator for producing a characteristic signal determined from a characteristic curve for the maximum amount of fuel to be injected into an internal combustion engine from an electronically controlled fuel injection pump, the generator has a memory in which a plurality of sets of characteristic data each representing a characteristic curve for the maximum amount of fuel to be injected are stored, and the necessary data is read out from the memory in response to the data relating to the engine speed at each instant.

4 Claims, 7 Drawing Figures

CHARACTERISTIC SIGNAL GENERATOR FOR AN ELECTRONICALLY CONTROLLED FUEL INJECTION PUMP

FIELD OF INVENTION

The present invention relates to a characteristic signal generator for electronically controlling a fuel injection pump, and more particularly to a circuit for generating a characteristic signal corresponding to the maximum amount of fuel that should be injected by a fuel injection pump into an internal combustion engine according to the engine's characteristics.

BACKGROUND OF THE INVENTION

In the conventional electronically controlled fuel injection pump for an internal combustion engine, in order to obtain desired governor characteristics, the optimum position of an adjusting member for adjusting the amount of fuel injected at any time is computed on the basis of input data indicative of the conditions of engine operation such as engine speed, amount of manipulation of the accelerator pedal etc., and the adjusting member is controlled by an actuator so as to be positioned at the optimum position in accordance with the computed result. In such a control system for a fuel injection pump, in order to avoid problems caused by excessive supply of fuel, such as the production of smoke due to imperfect fuel combustion, there is provided a circuit for limiting fuel injection in such a way that the amount of fuel injected is not more than a maximum value represented by a characteristic signal determined from a characteristic curve for the maximum amount of fuel to be injected, which is produced by a characteristic signal generator.

The characteristic curve for the maximum amount of fuel to be injected (referred to as a "full Q characteristic curve" hereinafter) must be decided so as to match the characteristics of the engine equipped with the fuel injection pump. For critically adjusting the full Q characteristic curve to the best condition, it is necessary to carry out adjustment of the characteristic curve under the actual operating condition of the fuel injection pump separately for each engine.

Therefore, the conventional electronically controlled fuel injection pump is arranged so as to be adjustable in its full Q characteristics. The full Q characteristics are a function of engine speed and are quite complex. The conventional device is arranged so that the full Q values are represented by a broken line curve and each segment of the broken line is adjusted in its positional level and/or its slope by the adjustment of variable resistors. Much time and skill are required for the adjusting operation. Consequently, it is difficult to reduce the cost for adjustment of the device and the adjusting operation is also inconvenient when carrying out an engine test.

SUMMARY OF THE INVENTION

It is, therefore, an object of the present invention to provide an improved characteristic signal generator for generating a signal indicative of the desired full Q characteristic curve in the electronically controlled fuel injection pump for internal combustion engines.

It is another object of the present invention to provide a circuit for generating a characteristic signal corresponding to full Q characteristics, in which the full Q characteristic curve can be easily changed without a troublesome adjusting operation.

It is a still another object of the present invention to provide a circuit for generating a characteristic signal corresponding to full Q characteristics, in which the desired full Q characteristic curve can be selected merely by a switching operation.

It is a further object of the present invention to provide a circuit for generating a characteristic signal, which is able to generate the characteristic signal repeatedly without any changes with the passage of time.

It is a still further object of the present invention to provide a circuit for generating a characteristic signal, which is suitable for application to the digital control system of an electronically controlled fuel injection pump.

According to the present invention, in a characteristic signal generator which produces a characteristic signal determined from a characteristic curve for the maximum amount of fuel to be injected into an internal combustion engine from an electronically controlled fuel injection pump, the characteristic signal generator comprises a first means for producing first data relating to the engine speed at each instant; a memory in which a plurality of characteristic sets of data each representing a characteristic curve for the maximum amount of fuel to be injected are stored; a second means for producing second data for selecting a desired set of characteristic data in the memory from the plurality of sets stored therein, the second data being applied to the memory to designate the desired set of characteristic data which is to be read out in response to the first data. The output data from the memory is, for example, applied to a digital-analog converter to change it into an analog signal relating to the maximum amount of fuel injected at that time. The second means may include a plurality of switches and the second data is produced as binary data, the content of which is determined in accordance with the open/close states of these switches. With this circuit structure, a characteristic signal corresponding to the desired full Q characteristic curve can be obtained simply by the operation of switching these switches of the second means, without further fine adjustment of the characteristic signal to compensate for peculiarities of each device. Therefore, adjustment or change of the full Q characteristic curve can be easily carried out without any trouble even by an unskilled operator.

Furthermore, according to the present invention, the characteristic signal generator may be arranged so as to include a first memory in which a set of a basic characteristic data corresponding to a basic full Q characteristic curve is stored and a second memory in which correcting data are stored to effect correction to the basic characteristic curve from the first memory data by the use of the correcting data. The correction based on the correcting data may be effected by adding the correcting data to the basic characteristic data or subtracting the correcting data from the basic characteristic data. In this case, although the basic characteristic data is readout from the first memory in response to the data relating to the engine speed, the value of the correcting data may be a constant or a function of the engine speed.

Further objects and advantages of the present invention will be apparent from the following detailed description to be read in conjunction with the accompanying drawings in which:

DETAILED DESCRIPTION

Figure 1:
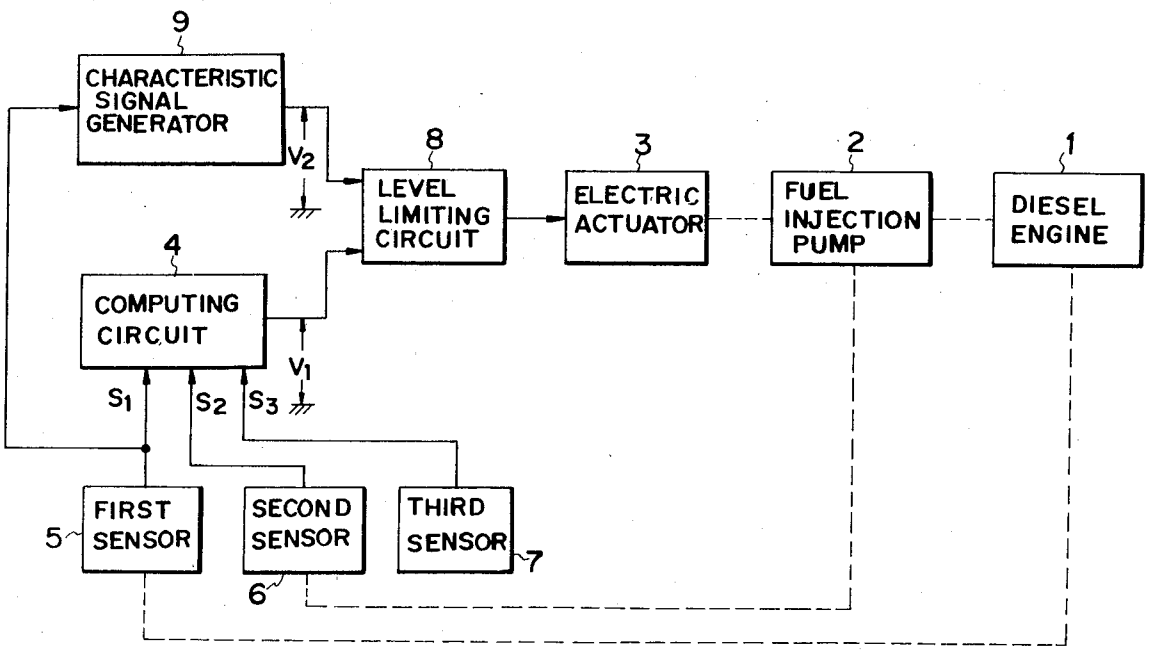
FIG. 1 is a block diagram of an electronically controlled fuel injection system to which a characteristic signal generator of the present invention is applied.

Referring to FIG. 1, there is shown a block diagram of an electronically controlled fuel injection system to which a characteristic signal generator of the present invention is applied, which generates a characteristic signal determined from a desired full Q characteristic curve representing the maximum amount of fuel to be injected into an engine 1 from a fuel injection pump 2. The fuel injection pump 2 may be a conventional pump having an adjusting member (not shown) for adjusting the amount of fuel injected into the engine 1, a distributed type injection pump or an in-line type injection pump. The adjusting member is operatively connected with an electric actuator 3 and the speed of the engine 1 can be controlled in accordance with the position of the adjusting member positioned by the electric actuator 3. In order to actuate the electric actuator 3 in such a way that the speed of the engine 1 is controlled in accordance with predetermined governor characteristics, there is provided a computing circuit 4 to which data representing the conditions of engine operation are applied. In this embodiment, the system has a first sensor 5 for generating a speed signal $S_1$ showing the speed of the engine 1, a second sensor 6 for generating a position signal $S_2$ showing the position of the adjusting member and a third sensor 7 for generating an acceleration signal $S_3$ showing the amount of manipulation of the accelerator pedal (not shown), and these signals $S_1$, $S_2$, and $S_3$ are applied to the computing circuit 4 in which the position of the adjusting member necessary for obtaining the engine speed set by the amount of manipulation of the accelerator pedal is computed on the basis of the input signals $S_1$, $S_2$, and $S_3$. The computing circuit 4 produces a control voltage signal $V_1$ having a voltage level which corresponds to the computed result, and the control voltage signal $V_1$ is applied through a level limiting circuit 8 to the actuator 3. The actuator 3 operates in response to the level of the control voltage signal $V_1$ and the position of the adjusting member is positioned at the place determined by the computation of the computing circuit 4.

The level limiting circuit 8 and a characteristic signal generator 9 in accordance with the present invention are provided for the purpose of limiting the amount of fuel injected in accordance with the desired full Q characteristic curve.

The characteristic signal generator 9 is a circuit responsive to the speed signal $S_1$ for generating a voltage signal $V_2$ which has level characteristics corresponding to the desired full Q characteristic curve, and the level of the voltage signal $V_2$ is determined so as to position the adjusting member at the position where an amount of injected fuel corresponding to the full Q value can be obtained when the voltage signal $V_2$ is applied to the actuator 3. The level limiting circuit 8 is responsive to the control voltage signal $V_1$ and the voltage signal $V_2$, the voltage signal with the lower level being output from the level limiting circuit 8. More specifically, control voltage signal equal to $V_1$ is output from the level limiting circuit 8 when the level of the control voltage level $V_1$ is not more than that of the voltage level $V_2$, and the actuator 3 is driven in response to the control voltage signal $V_1$. On the other hand, a voltage signal equal to $V_2$ is output from the level limiting circuit 8 when the level of the control voltage signal $V_1$ is more than that of the voltage signal $V_2$, and the actuator 3 is driven in response to the voltage signal $V_2$ irrespective of the level of the voltage signal $V_1$. As a result, the actuator 3 operates the adjusting member 3 in such a way that the amount of fuel injected does not exceed the maximum amount of fuel injected which is decided by the voltage signal $V_2$ (e.g. the full Q value).

The characteristic signal generator 9 is able to produce characteristic signals in accordance with a plurality of characteristic curves and the desired characteristic curve can be selected from among these by the operation of switches.

Figure 2:
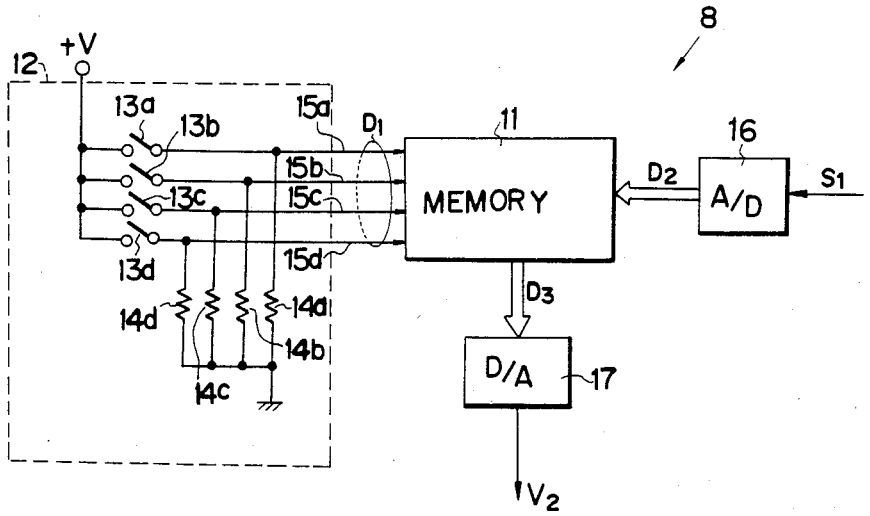
FIG. 2 is a detailed block diagram of the characteristic signal generator shown in FIG. 1.

FIG. 2 shows a detailed schematic diagram of the characteristic signal generator 9 of FIG. 1. The characteristic signal generator 9 has a memory 11 in which sixteen sets of characteristic data each representing a full Q characteristic curve are stored in digital form. In this embodiment, the memory area of the memory 11 is divided into sixteen areas in which the sixteen sets of characteristic data are stored respectively, and a common addressing system is used for the areas.

In order to read out a desired set of the characteristic data from the memory 11, the memory 11 is connected to a selector 12 including four switching elements $\mathbf{13}_a$ to $\mathbf{13}_d$. One terminal of each switching element is connected to a voltage source +V and the other terminal of each is grounded through resistors $\mathbf{14}_a$ to $\mathbf{14}_d$, respectively. The other terminals of the switching elements are also connected to the memory 11 by lines $\mathbf{15}_a$ to $\mathbf{15}_d$. Therefore, when these switching elements $\mathbf{13}_a$ to $\mathbf{13}_d$ are selectively closed or opened, the levels appearing on the lines $\mathbf{15}_a$ to $\mathbf{15}_d$ become high or low and 4-bit binary data can be supplied to the memory 11 as selection data $D_1$. That is, as the selection data $D_1$ is 4-bit data, a desired area of the sixteen areas can be selected by the selection data $D_1$.

On the other hand, the speed signal $S_1$, the level of which changes in accordance with the change of the engine speed N, is applied to an analog-digital (A/D) converter 16 to convert the corresponding digital data $D_2$, and the digital data $D_2$ is applied to the memory 11 as read-out address data. In the respective areas of the memory 11, the respective sets of the characteristic data are stored in such a way that the data corresponding to the maximum amount of fuel injection at the engine speed represented by the digital data $D_2$ is stored at the address designated by the data $D_2$. Consequently, an area in which the desired set of the characteristic data is stored is selected by the selection data $D_1$ from the selector 12, and data in the selected area is further selected in accordance with the data $D_2$.

The output data $D_3$ from the memory 11 is converted into a corresponding analog voltage signal in a digital-analog (D/A) converter 16 and the converted analog voltage is output as the voltage signal $V_2$. As will be understood from the foregoing description, each subset of data stored in the memory 11, which corresponds to the maximum amount of fuel to be injected at the engine speed designated by the data $D_2$, is output and converted into a voltage signal by which the adjusting member is positioned at the position where the amount of fuel injected corresponding to the data stored in the memory 11 can be obtained.

Figure 3:
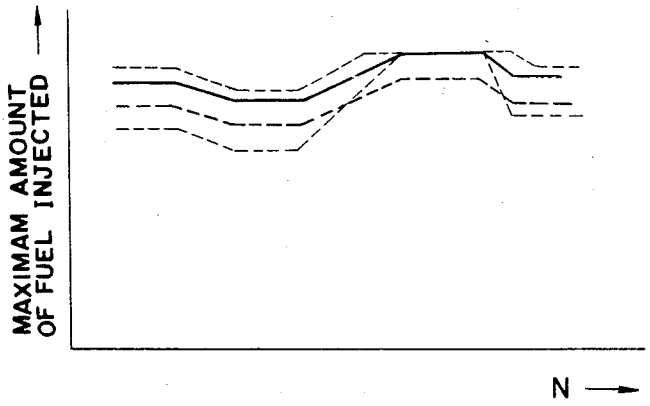
FIG. 3 shows the full Q characteristic curves provided by the data from the memory shown in FIG. 2.

With this circuit structure, for example, in addition to a set of data corresponding to the basic full Q characteristic curve shown by the solid line of FIG. 3, a plurality of sets of data corresponding to modified full Q characteristic curves shown by the broken lines of FIG. 3, may be stored in the memory 11, and solely by switching of the selector 12, changeover among the full Q characteristic curves can be easily carried out. As a result, the operation of adjusting the characteristics of the fuel injection pump becomes extremely easy as compared with the conventional device in which such an adjustment must be carried out by the adjustment of variable resistors. Furthermore, according to the characteristic signal generator 11, since a set of data corresponding to the desired full Q characteristic curve can be read out from the memory 11 by the switching of the selector 12, it is possible to output the same characteristic data repetitively, and there is no change in the characteristics even over a long time. Still further, the processing of signals is carried out in digital system by the use of the memory. Therefore the characteristic signal generator can be easily applied in an electronically controlled governor device for a fuel injection pump in which the control operation is carried out by the use of a digital micro-computer.

In the above-mentioned embodiment, although the sixteen sets of data corresponding to the full Q characteristic curves are stored in the respective divided areas of the memory 11, the manner of storing the sets of data is not limited to that shown in the embodiment.

Figure 4:
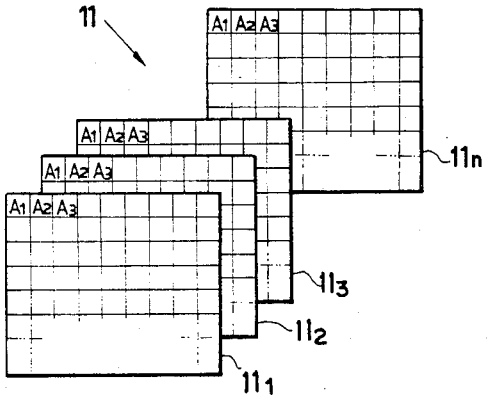
FIG. 4 is a view illustrating one example of the sturcture of the memory shown in FIG. 2.

For example, as shown in FIG. 4, the memory 11 may include a plurality of memory chips $\mathbf{11}_l$ to $\mathbf{11}_n$ in which sets of data corresponding to the full Q characteristic curves are stored, a common addressing system ($A_1$, $A_2$, . . . ) is used for the chips, and the data $D_1$ may be applied to the memory 11 as chip select data.

Furthermore, in FIG. 2, these sets of characteristic data may be stored in the memory 11, without dividing the memory area of the memory 11, in such a way that the desired kind of characteristic data is read out from the memory 11 when both data $D_1$ and $D_2$ are applied to the memory 11 as address data.

Figure 5:
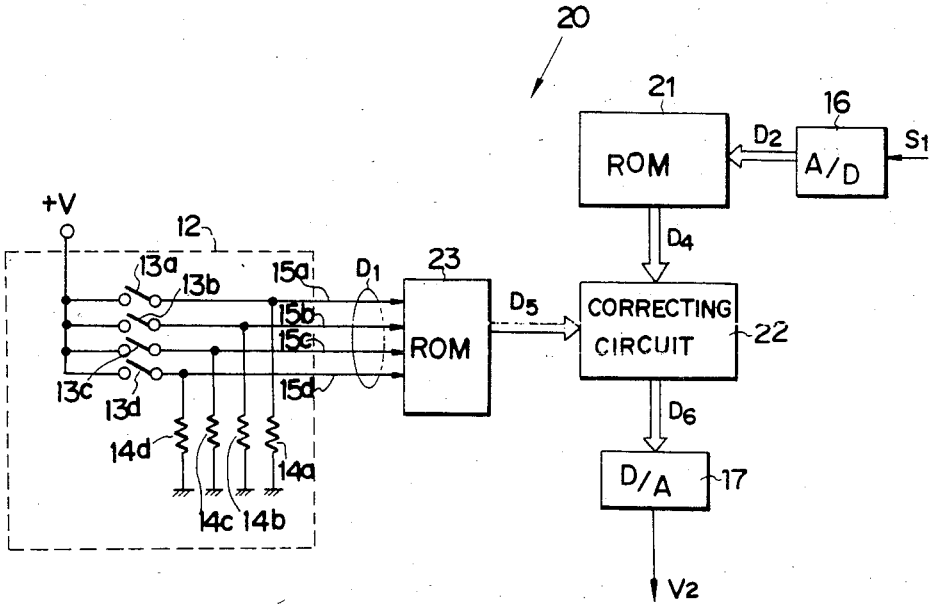
FIG. 5 is a block diagram of another embodiment of the characteristic signal generator of FIG. 1.
Figure 6:
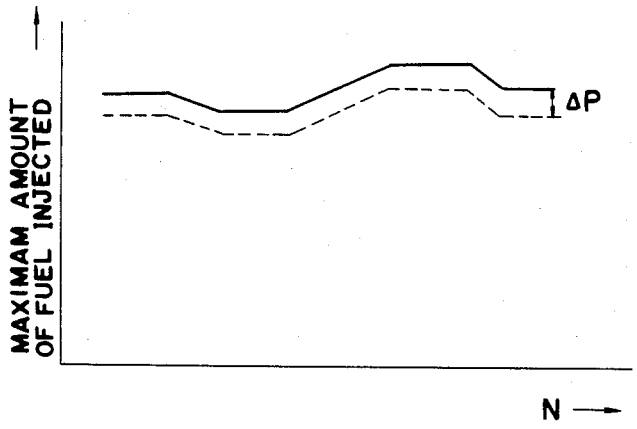
FIG. 6 shows the full Q characteristic curves provided by the output data from the characteristic signal generator shown in FIG. 5.

Another embodiment of the characteristic signal generator is shown in FIG. 5, wherein portions the same as those in FIG. 2 are designated by like reference numerals. In this embodiment, a characteristic signal generator 20 has a read only memory (ROM) 21 in which a set of data concerning the basic full Q characteristic curve shown by the solid line of FIG. 6 is stored. Like the characteristic curves shown in FIG. 3, the basic full Q characteristic curve in FIG. 6 is a function of the engine speed N, and shows the relationship between the engine speed N and the maximum amount of fuel to be injected. A set of data corresponding to the basic full Q characteristic curve is stored in the ROM 21 in such a way that when the data from the A/D converter 16 is applied to the ROM 21 as address data, the data corresponding to the engine speed N shown by the applied data $D_2$ is read out from the ROM 21. Thus, it follows that the data relating to the maximum amount of fuel to be injected at that engine speed is produced from the ROM 21 as the basic data $D_4$ for controlling the position of the adjusting member in accordance with the characteristic curve shown by the solid line in FIG. 6.

The data $D_4$ is applied to a correcting circuit 22 which effects correction of the data $D_4$ in accordance with the correcting data $D_5$ from a ROM 23. The correcting data $D_5$ represents the amount of displacement - $\Delta P$ of the basic full Q characteristic curve shown in FIG. 6, and the data $D_5$ is added to the basic data $D_4$ in the correcting circuit 22, so that the output data $D_6$ corresponds to the characteristic curve obtained by parallelly displacing the curve of the basic full Q characteristic curve by the amount - $\Delta P$. The output data $D_6$ is applied to the D/A converter 17 to convert it into the corresponding analog data. The output analog data from the D/A converter 17 is delivered as the voltage signal $V_2$.

In order to be able to change the value of $\Delta P$, various values (and the signs) of $\Delta P$ are stored in the ROM 23 and one of the values of $\Delta P$ is selected in response to the selection data $D_1$ produced by the selector 12. The data $D_1$, which is 4-bit digital data, is applied to the ROM 23 as address data and corresponding correcting data in the ROM 23 is read out in response to the selection data $D_1$. Since the relationship between the value of the selection $D_1$ and the value of the data $D_5$ is decided in advance, the desired value of $\Delta P$ can be selected by only the switching of the switch elements $\mathbf{13}_a$ to $\mathbf{13}_b$.

The correcting operation is carried out on the basis of the correcting data $D_5$ from the ROM 23, so that the amount of displacement $\Delta P$ can be exactly set and the operation of changing the characteristic curve is remarkably simplified. This is convenient especially for the adjustment of the maximum output of the engine.

Although the data correcting operation in the embodiment shown in FIG. 5 is carried out by displacing the basic characteristic curve in parallel with itself, the correcting operation may be carried out by rotating the basic full Q characteristic curve or by any other manner.

Figure 7:
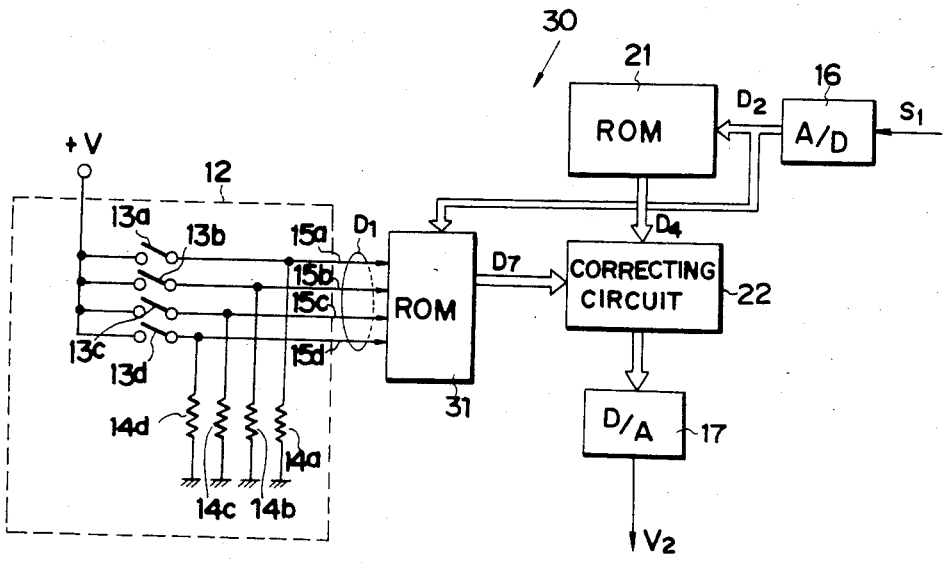
FIG. 7 is a block diagram of a modified embodiment of the characteristic signal generator shown in FIG. 5.

FIG. 7 is a schematic diagram of a modified embodiment of the characteristic signal generator of FIG. 5 in which the same portions as those in FIG. 5 are designated by the same reference numerals. The characteristic signal generator 30 shown in FIG. 7 is different from the characteristic signal generator 20 of FIG. 5 in that each piece of correcting data $D_7$ is not a constant value but is a function of the engine speed N.

That is, in a ROM 31 for producing the correcting data $D_7$, a plurality sets of data for correcting the data $D_4$ from the ROM 21 are stored and a desired set of data is selected in accordance with the selection data $D_1$. The data $D_2$ indicating the engine speed N is also applied to the ROM 31 as address data to read out a predetermined piece of correcting data corresponding to the engine speed in the set of data designated by the data $D_1$. The data structure of the ROM 31 is similar to that of the ROM 11 of FIG. 2. The data $D_4$ is corrected by the correcting data $D_7$ in the correcting circuit 22 in a similar manner to that of the characteristic signal generator 20.

With this circuit structure, the data correction is not limited to parallel displacement, but various correcting operations can be carried out by changing a given portion or all of the basic full Q characteristic curve. Therefore, it is possible to change the basic full Q characteristic curve into one of those shown by the broken lines in FIG. 3.

In the embodiments shown in FIGS. 5 and 7, although the correcting circuit 22 is a circuit for adding the data $D_4$ and $D_5$ or $D_4$ and $D_7$, the correcting circuit 22 may be arranged in such a way that a set of data corresponding to the characteristic curve obtained by rotating the basic full Q characteristic curve is computed on the basis of the required data from the ROM 31. For realizing the computation described above, the required data for deciding the condition of the rotation of the basic full Q characteristic curve, such as data concerning the center of rotation and the angle of rotation, may be stored in the ROM 31 and the desired set of data in the ROM 31 may be read out by the application of the data $D_1$.

According to the circuit structure shown in FIG. 7, it is possible to obtain many kinds of characteristic signals for the maximum amount of fuel to be injected by a memory with small capacity, since the necessary characteristic data is computed on the basis of the basic characteristic data and the correcting data.

We claim:

1. A characteristic signal generator which produces a characteristic signal determined from a characteristic curve for the maximum amount of fuel to be injected into an internal combustion engine from an electronically controlled fuel injection pump, said signal generator comprising:

a first means for producing first data relating to the engine speed at each instant;

a first memory for storing a set of basic characteristic data representing a basic characteristic curve for the maximum amount of fuel to be injected, said basic characteristic data being a function of the engine speed where said first memory outputs a desired subset of the basic characteristic data in response to the first data from said first means;

a second memory for storing a plurality of sets of correcting data for correcting the basic characteristic curve as represented by the basic characteristic data stored in said first memory;

a second means for producing second data for selecting a desired set of correcting data in said second memory, the second data being applied to said second memory to select the desired set of correcting data;

means responsive to the data from said first and second memories for correcting the basic characteristic data by the use of the correcting data; and means for converting the data from said correcting means into a characteristic signal for controlling the maximum amount of fuel to be injected.

2. A characteristic signal generator as claimed in claim 1 wherein said second means has a plurality of switches and the second data is changed by the ON/-OFF operation of the switches.

3. A characteristic signal generator as claimed in claim 1 wherein each set of correcting data stored in said second memory is constant data.

4. A characteristic signal generator as claimed in claim 1 wherein each set of correcting data stored in said second memory is a set of data the characteristics of which are a function of the engine speed and the correcting data is read out in response to the first data.

* * * * *